US009499003B2

(12) United States Patent
Huotari et al.

(10) Patent No.: US 9,499,003 B2
(45) Date of Patent: Nov. 22, 2016

(54) BINDING SUPPORT THAT CAN BE USED IN BOOKBINDING, METHOD FOR BINDING A BUNDLE OF SHEETS AND DEVICE ARRANGEMENT THAT CAN BE USED IN BOOKBINDING

(75) Inventors: Lauri Huotari, Espoo (FI); Iisakki Huotari, Espoo (FI)

(73) Assignee: Maping Kommandiittiyhtio L. Huotari (FI)

( * ) Notice: Subject to any disclaimer, the term of this patent is extended or adjusted under 35 U.S.C. 154(b) by 521 days.

(21) Appl. No.: 14/126,050

(22) PCT Filed: Jun. 20, 2012

(86) PCT No.: PCT/IB2012/053117
§ 371 (c)(1),
(2), (4) Date: Dec. 13, 2013

(87) PCT Pub. No.: WO2012/176137
PCT Pub. Date: Dec. 27, 2012

(65) Prior Publication Data

US 2014/0119853 A1 May 1, 2014

(30) Foreign Application Priority Data

Jun. 22, 2011 (DE) ..... 10 2011 078 020

(51) Int. Cl.
*B42B 5/00* (2006.01)
*B42B 5/06* (2006.01)
(Continued)

(52) U.S. Cl.
CPC ..... *B42B 5/06* (2013.01); *B25C 5/0228* (2013.01); *B25C 7/00* (2013.01); *B27F 7/006* (2013.01); *B27F 7/19* (2013.01); *B42B 2/10* (2013.01); *B42B 4/00* (2013.01); *B25C 5/02* (2013.01)

(58) Field of Classification Search
CPC ..... B25C 5/00; B25C 5/02; B25C 5/0228; B25C 5/0214; B25C 5/10; B25C 5/15; B25C 7/00; B27F 7/00; B27F 7/025; B27F 7/006; B27F 7/19; B42B 4/00; B42B 2/00; B42B 2/10; B42B 5/00; B42B 5/02; B42C 7/00; B42C 11/02; B65B 51/00; B65B 51/05
USPC ..... 227/110, 111, 131, 140, 151, 152, 154, 227/156; 269/47, 54.4, 303, 315
See application file for complete search history.

(56) References Cited

U.S. PATENT DOCUMENTS 1,692,779 A * 11/1928 Kline ..... B26F 1/36 269/303
2,776,431 A * 1/1957 Strong ..... B42B 4/00 227/110

(Continued)

FOREIGN PATENT DOCUMENTS

DE 2290257 12/1995

OTHER PUBLICATIONS

International Preliminary Report on Patentability for PCT Application PCT/IB2012/053117, WIPO Jan. 9, 2014.

*Primary Examiner* — Scott A. Smith

(57) ABSTRACT

A binding platform that can be used in bookbinding, which comprises a supporting surface suitable for supporting a bundle of sheets, a number of finger-like members extending from the edge of supporting surface essentially perpendicularly to the supporting surface and against which the rear edge of the bundle of sheets to be placed on the supporting surface can be aligned and which are configured in such a way that a stapling gap remains between each of the finger-like members. At least one limiter is located under the finger-like members and supporting surface, the limiter being indented with respect to the inner edge of the stapling gaps.

16 Claims, 9 Drawing Sheets

(51) Int. Cl.

| | |
|---|---|
| ***B42B 2/10*** | (2006.01) |
| ***B27F 7/19*** | (2006.01) |
| ***B27F 7/00*** | (2006.01) |
| ***B25C 7/00*** | (2006.01) |
| ***B42B 4/00*** | (2006.01) |
| *B25C 5/02* | (2006.01) |

(56) References Cited

U.S. PATENT DOCUMENTS 3,016,538 A * 1/1962 Oussani ..... B25C 5/0228 227/109
3,101,478 A * 8/1963 Oussani ..... B25C 5/0214 227/131
4,102,543 A * 7/1978 Smith ..... G09B 19/22 227/109
4,610,386 A * 9/1986 Augostini ..... B25C 5/0228 227/131
5,390,842 A * 2/1995 Joyce ..... B27F 7/025 227/110
5,626,275 A * 5/1997 Chen ..... B25C 5/0214 227/110
5,692,666 A 12/1997 Dallas
5,806,749 A * 9/1998 Chen ..... B25C 5/15 227/110
6,715,656 B1 * 4/2004 Stanard ..... B27F 7/006 227/110
7,090,110 B2 * 8/2006 Adams ..... B25C 5/0228 227/120
7,306,131 B2 * 12/2007 Bargo ..... B25C 5/0228 227/110

* cited by examiner

BINDING SUPPORT THAT CAN BE USED IN BOOKBINDING, METHOD FOR BINDING A BUNDLE OF SHEETS AND DEVICE ARRANGEMENT THAT CAN BE USED IN BOOKBINDING

TECHNICAL FIELD

The invention relates to the field of bookbinding in general and to the devices and methods for binding and casing in a bundle of sheets in particular.

BACKGROUND INFORMATION

A bundle of sheets may be bound by stapling in several places along the rear edge of a bundle of sheets. It is common to use a conventional stapler on the job, in particular a conventional office stapler for desktop use or a pliers stapler.

The trouble is, that a binding created by a conventional stapling device does not open evenly. When opened, the pages of the bundle of sheets tend to form waves. For these reasons, a book manufactured from such a bound bundle of sheets is often considered to be of low quality.

SUMMARY

It is the object of the invention to enable manufacturing of a book to be compiled, which has a higher quality, by using a bound bundle of sheets.

This object can be realized by using the binding platform that can be used in bookbinding according to claim 1 as well as the device arrangement according to claim 16. The object may also be solved by using the method according to claim 13 for binding a bundle of sheets.

The dependent claims describe advantageous embodiments of the binding platform and the method.

The binding platform that can be used in bookbinding comprises a supporting surface suitable for supporting a bundle of sheets and finger-like members extending from the edge of the supporting surface essentially perpendicularly to the supporting surface, against which the rear edge of the bundle of sheets to be placed on the supporting surface can be aligned, and which are configured in such a way that a stapling gap remains between each of the finger-like members.

In addition to that the binding platform comprises at least one limiter located under the finger-like members and the supporting surface, the limiter being indented with respect to the inner edge of the stapling gaps.

Where a bound bundle of sheets is concerned, the inventors observed that according to the state of the art the creation of wavy pages can be attributed to the staples not being in the same distance from the binding edge of the bundle of sheets to be bound. In addition to that, part of the staples may also be askew. For these reasons, the fold easily forms waves when the book is opened.

By use in accordance with the stapling platform described above, market-standard pliers staplers may usually be used for binding a book thanks to the stapling gap. The pliers stapler is placed in the stapling gap, which guides the pliers stapler into the correct position. Thanks to the limiter, correct alignment of the pliers stapler is made easier: If the pliers stapler is pushed up to the limiter, the staple penetrating the bundle of sheets does not hit the stapling row too close to the binding edge. As the pliers stapler cannot be pushed beyond the limiter, the staple does also not hit the rear side of the stapling line, i.e. further away from the binding edge.

If the width of the limiter is equal to or wider than the distance between the outermost stapling gaps, this enables that precise alignment of the staples is possible at all stapling points.

If there is at least one supporting member located under or extending under stapling gap arranged on the binding platform in combination with the at least one limiter, use of the pliers stapler can be made easier by means of the binding platform and, thus, a precise way of working can be supported, as the hands of the user do not tire so quickly, because the pliers stapler rests on the supporting member.

If the supporting member comprises a continuous plane surface, whose width is equal to or wider than the distance between the outermost stapling gaps, early tiring of the user's hands during the whole period of processing the binding edge can be reduced.

If the binding platform can be supported by the edge of a worktable, a binding of good quality can be realized by using conventional business or office furniture. This is simplified particularly, if the binding platform is configured such that the inner side of the limiter and the point of attachment of the supporting surface form a corner, which can be supported by the edge of the worktable. In this way the user cannot shove the pliers stapler deeper into the supporting surface accidentally, as the edge of the worktable prevents this. This reduces the risk of the user fixing staples in a wrong distance to the binding edge due to the movement of the supporting surface.

If the binding platform additionally comprises a lateral edge level, which is located on the supporting surface, indented with respect to the inner edge of the stapling gaps, fixing the staples in the same place with each bundle of sheets can be ensured.

If the finger-like members are formed from a deflected plate, their realization is fairly simple, where manufacturing technique is concerned. It is particularly advantageous in this case, if the supporting surface consists of a plate that is set against the finger-like members in such a way that a raising plate is mounted between the said plate and the deflected plate in order to compensate the curvature resulting from deflection, thus causing the finger-like members to form an essentially right angle with the binding platform. This is a simple method to ensure a right angle of the finger-like members, regardless of the rounding resulting from deflection.

If the binding platform also comprises a member opposite the finger-like members for positioning a book cover between the finger-like members and the opposite member, the finger-like members may not only be used for guiding pliers staplers, but also for another purpose, namely for positioning a book cover.

If such a binding platform also comprises a lateral guiding device under which the book cover can be pushed in a lateral direction and against which the bound bundle of sheets can be aligned with respect to the book cover, indention of the bundle of sheets with respect to the book cover by using the binding platform can be ensured by fairly simple means.

If under the guiding device there is a stopper mounted, whose distance from the guiding device can be adjusted, the user may decide by using the binding platform, how much indention is desired. Thereby the binding platform becomes more suitable for covers of different types and, thus, it can be used for multiple purposes.

In the method for binding a bundle of sheets, the bundle of sheets is bound on its one edge by using the binding platform that can be used in bookbinding according to one of the preceding claims and a pliers stapler.

The method enables binding a bundle of sheets in such a way that a book of high quality may be manufactured from the bound bundle of sheets by using simple means—a conventional pliers stapler and the binding platform according to the present invention.

According to a first advantageous embodiment of the method, a self-adhesive sheet is used as a top and/or bottom sheet in the bundle of sheets to be bound, which self-adhesive sheet most advantageously having at least one attenuation member at its rear edge.

A second advantageous embodiment of the method can be used then, if the binding platform comprises a lateral guiding device, under which the book cover may be pushed in in lateral direction and with which the bound bundle of sheets can be aligned with respect to the book cover. The binding platform may have a stopper below the guiding device, the stopper's distance preferably being adjustable.

In this case, the hard book cover is positioned between the finger-like members and the opposite member and is pushed under the lateral guiding device. Thereafter the bound bundle of sheets is pushed against the lateral guiding device. Thereafter the protective paper is removed from the self-adhesive cover or covers and the bound bundle of sheets is fixed to the book cover.

BRIEF DESCRIPTION OF THE DRAWINGS

The binding platform and the method for binding a bundle of sheets will be further explained below by means of the examples described in the enclosed drawings FIG. 1-21 which show.

The same reference numbers refer to the same technical features in all drawings.

DETAILED DESCRIPTION OF THE PREFERRED EMBODIMENTS

Figure 1:
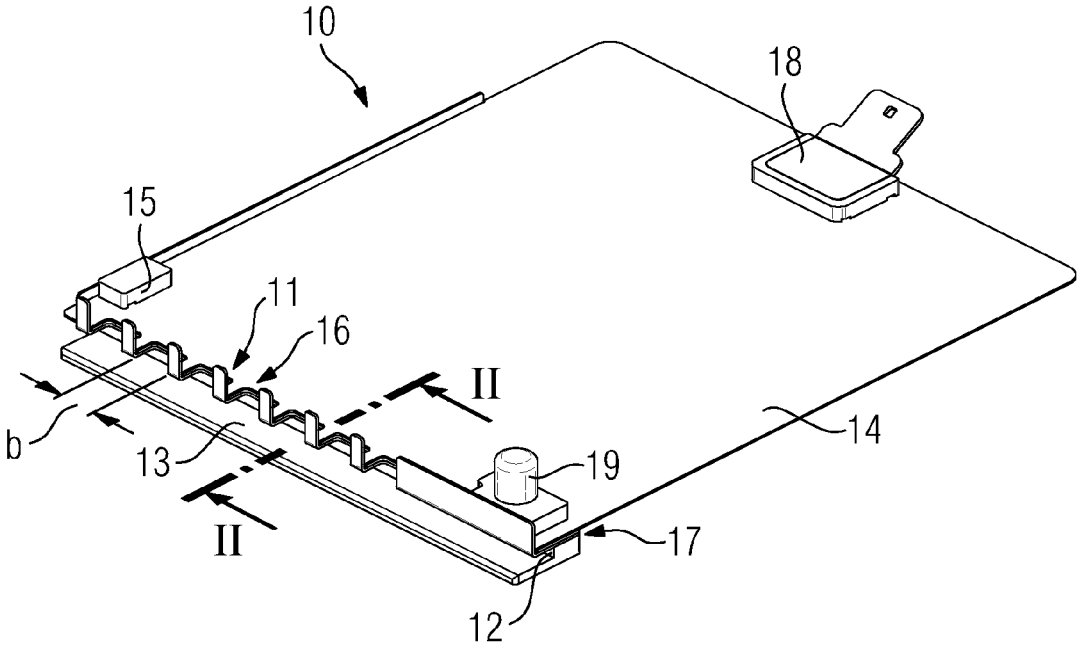
FIG. 1 is a perspective view of the binding platform according to the invention.

FIG. 1 shows the binding platform 10. The binding platform 10 comprises a supporting surface 14 suitable for supporting a bundle of sheets as well as finger-like members 11 extending upward from the edge of the supporting surface 14 essentially perpendicularly to the supporting surface 14. In the case of FIG. 1, the number of finger-like members 11 is seven, but more or less finger-like members 11 may be arranged for. Nevertheless, there are at least two finger-like members 11. The rear edge of the bundle of sheets to be positioned on supporting surface 14 can be aligned with finger-like members 11.

The finger-like members 11 are configured such that a stapling gap 16 remains between them. In addition to that, the binding platform 10 comprises at least one limiter 12 located under the finger-like members 11 and the supporting surface 14, the limiter 12 being indented with respect to the inner edge of the stapling gaps 16 and preferably extending the entire length of the edge of supporting surface 14 along which the finger-like members extend. In the most advantageous way, the width of the limiter 12 is equal to or wider than the distance between the outermost stapling gaps 16.

Should the number of finger-like members 11 be two, the number of stapling gaps 16 is one. If there are more finger-like members 11, there are more stapling gaps, respectively.

In combination with the at least one limiter 12, at least one supporting member 13 positioned under or extending under the stapling gap 16 is arranged, which in the most preferred way will be realized as a shelf-like supporting plane. The supporting member 13 then comprises a continuous plane surface, whose width is equal to or wider than the distance between the outermost stapling gaps 16. In the most preferred way, the plane surface is realized as plate or as batten.

The binding platform 10 can be supported by the edge of a worktable. In the most preferred way this can be realized, if the binding platform 10 is configured such, that the inner side 17 of limiter 12 and the point of attachment of supporting surface 14 form a corner, which can be supported by the edge of the working table.

Preferably, the binding platform 10 also comprises a lateral edge level 15, which is located on the supporting surface 14, indented with respect to the inner edge of the stapling gaps 16.

Figure 2:
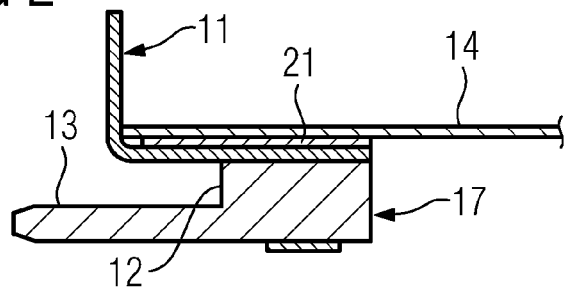
FIG. 2 cross-section along lines II-II of the binding platform shown in FIG. 1.

According to cross-section II-II shown in FIG. 2, the finger-like members 11 can preferably be formed from a deflected (bent or angled) plate. Preferably, the supporting surface 14 is formed from a plate that is set against the finger-like members 11 in such a way that a raising plate 21 is mounted between the deflected plate and the plate forming the supporting surface 14 in order to compensate the curvature resulting from deflecting, with the consequence that the finger-like members 11 form an essentially right angle with the supporting surface 14.

Figure 3:
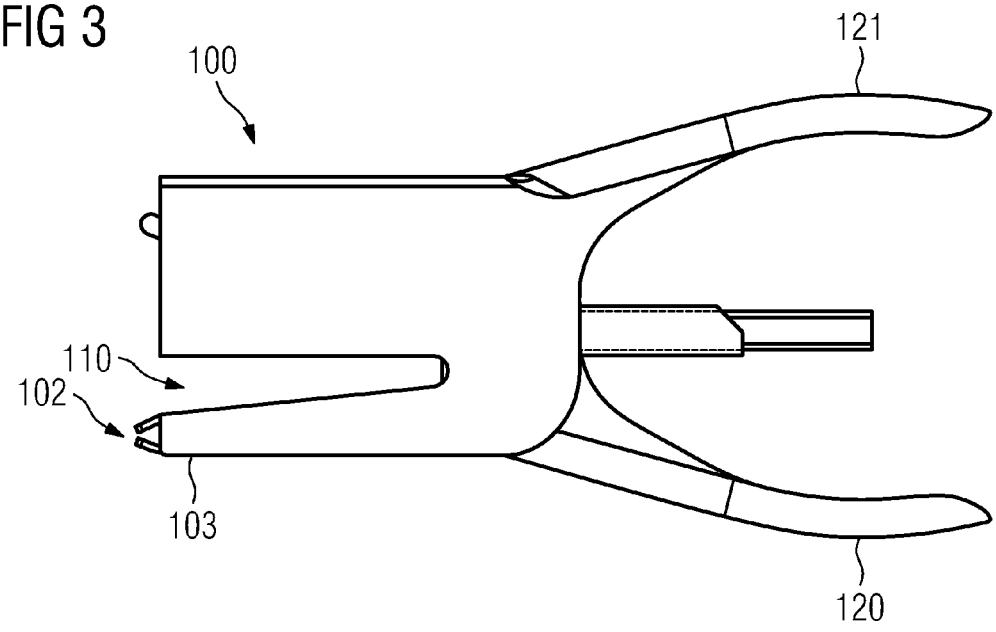
FIG. 3 is an example of a pliers stapler.

FIG. 3 shows a conventional, market-standard pliers stapler 100. For example, Rapid® K1—stapling pliers by Isaberg Rapid AB may be used as pliers stapler 100, which can staple up to 40 sheets in one go. Any other pliers stapler can, however, be used as pliers stapler 100. By means of the pliers stapler 100 staples are shot into the material, which is located in the mouth 110 of pliers stapler 100, if the handles 121 and 120 are pressed towards each other. A striker from within the upper clamping jaw of pliers stapler 100 then presses against the lower clamping jaw 103 of pliers stapler 100, in which the striker releases a staple from the stapling comb transported within the upper clamping jaw and presses it through the material located in its mouth 110 against the anvil of the lower clamping jaw 103. Thereafter, the anvil and the striker cooperate to bend the staples by laterally bending the part that passed through the material. The pliers stapler 100 may also have fins 102.

If there are more than two of the finger-like members 11, the width B of stapling gap 16 is in the most preferable way chosen thus, that it is only just possible to push the pliers stapler 100 into the stapling gap 16 such, that the mouth 110 of the pliers stapler 100 is placed on the edge of the bundle of sheets to be bound at stapling gap 16.

If there are two of the finger-like members 11, side alignment of the staples is realized visually.

Figure 4:
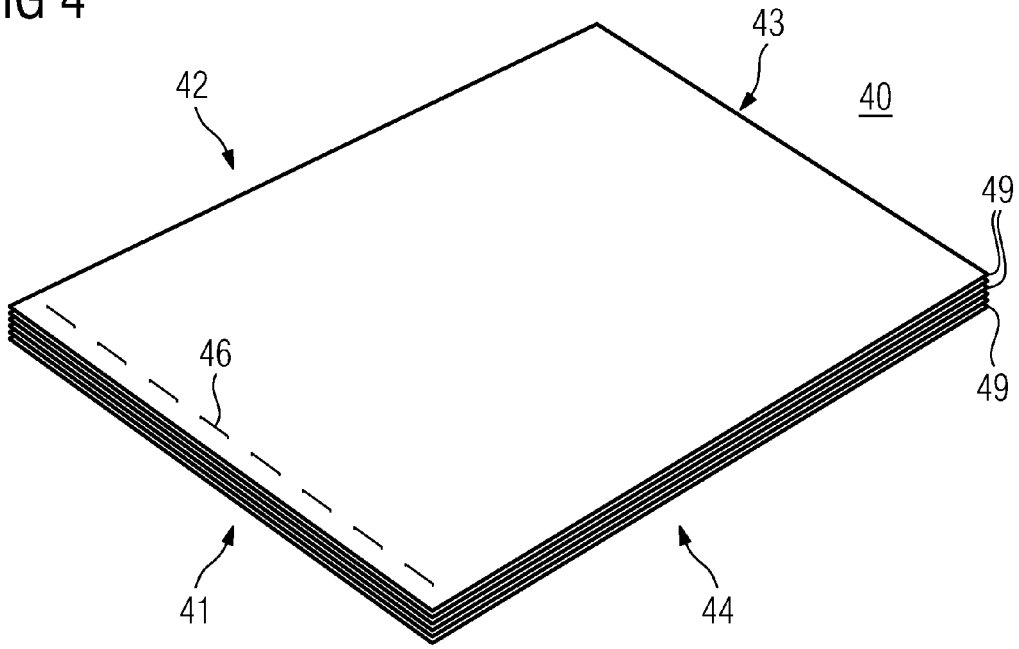
FIG. 4 is a bundle of sheets bound by stapling.

FIG. 4 shows a bundle of sheets 40. Rear edge 41 of the bundle of sheets 40 means that edge 41 of the edges 41, 42, 43, 44 of the bundle of sheets 40, on which the individual sheets 49 of the bundle of sheets 40 are tied up.

If the bundle of sheets 40 is bound as a vertical book, the rear edge 41 is typically the longer edge of the bundle of sheets 40, that is, longer than the adjacent edges 42, 44.

If the bundle of sheets 40 is bound as a horizontal book, the rear edge 41 is the shorter edge of the bundle of sheets 40, that is, shorter than the adjacent edges 42, 44.

If the bundle of sheets 40 is bound as a square book, the dimensions of the rear edge 41 are equal to those of the edges 42, 44, which are adjacent to rear edge 41. The bundle of sheets 40 according to FIG. 4 is bound by means of several staples 46 along rear edge 41.

FIGS. 15-18 illustrate how the binding platform 10 and the pliers stapler 100 are used for binding a bundle of sheets according to a preferred embodiment of the present invention.

Figure 15:
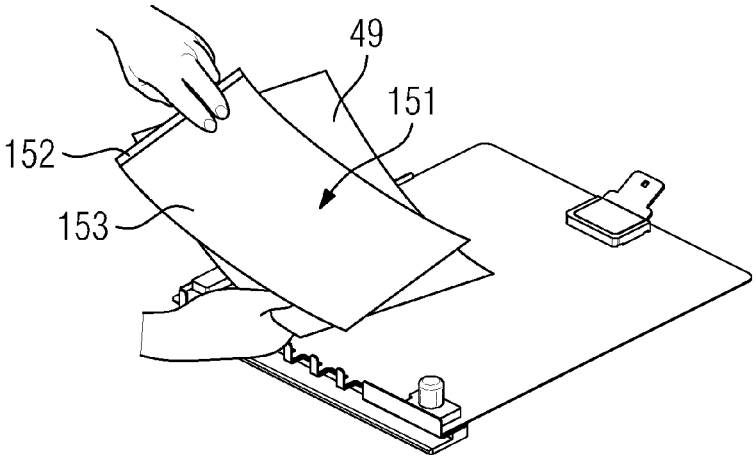
FIGS. 15-20 illustrate the method of binding as well as of fixing a bundle of sheets to hard book covers using the binding platform of the present invention.

A bundle of sheets 49 is inserted according to FIG. 15. According to a preferred (but not required) embodiment, an inner cover sheet 151 (such as described for example in patent application EP 2 213 472 A1 having at least one attenuation element 152 and being equipped with a self-adhesive surface and a protective paper 153) is attached as top and bottom sheet of the bundle, which may in particular be of the type Fastbind End Sheet for Fastbind BooXTer® Duo or Uno.

Figure 16:
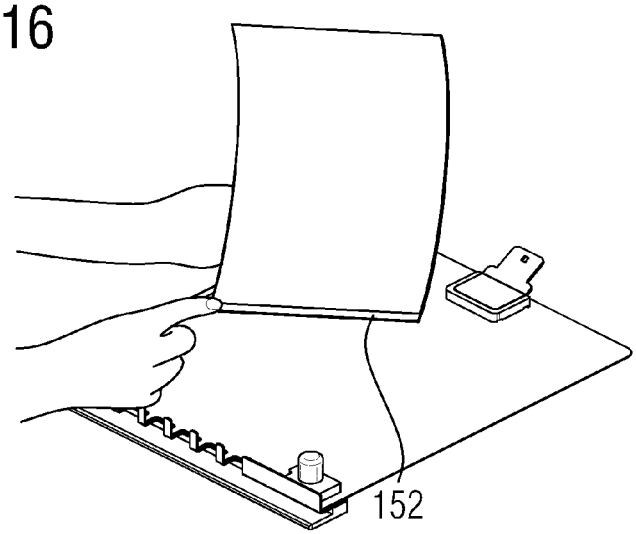

The sheets of the bundle of sheets 49 are placed on each other front to front in the way shown in FIG. 16. If an inner cover sheet 151 having at least one attenuation element 152 is used, the attenuation element is placed on the same side as the rear edge.

Figure 17:
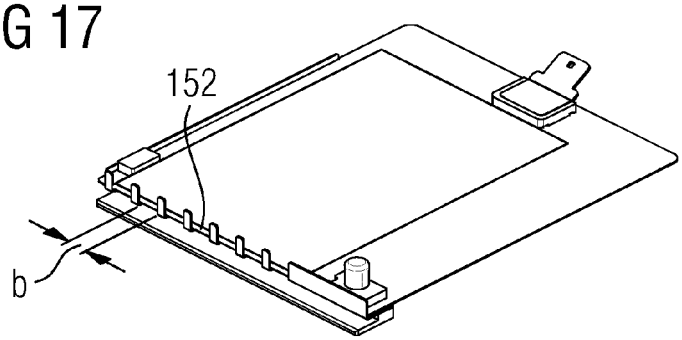

The rear edge of the bundle of sheets is aligned with the finger-like members 11 in the way shown in FIG. 17.

Figure 18:
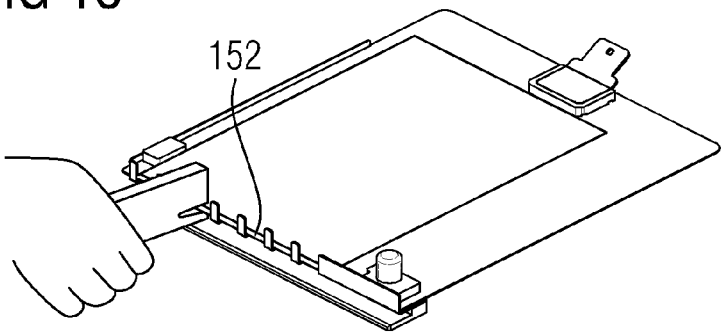

Following that, the bundle of sheets is bound at one edge (the rear edge) in the way shown in FIG. 18 by using the binding platform 10 and the pliers stapler 100, in the most preferred way in each stapling gap 16. The mouth 110 of pliers stapler 100 is pushed so far over the edge of the bundle of sheets at stapling gap 16, that the lower clamping jaw 103 or the fins 102 of pliers stapler 100 touch the limiter 12. The finger-like members 11 serving as edges of the stapling gap 16 guide the pliers stapler 100 into the right position where inclination is concerned.

If the lower clamping jaw 103 of the pliers stapler 100 rests on supporting member 13, alignment of the staple 46 will be very precise, because the pliers stapler 100 will be unable to incline in the vertical direction. The inventors observed that use of the supporting member 13 improves the result considerably, because in this way the staples 46 can be aligned much better than without use of the supporting member 13.

Although an inner cover sheet 151 having a self-adhesive surface and a protective paper 153 is also used as top and/or as bottom sheet in the bundle of sheets to be bound according to a preferred embodiment, the inner cover sheet additionally comprising at least one attenuation element 152 at the rear edge according to a preferred embodiment, this is not absolutely necessary. Bundles of sheets as shown in FIG. 4 may also be bound by using the method.

In the way resulting from FIG. 1, the binding platform 10 additionally comprises a member 18 being located opposite to finger-like members 11 for positioning a book cover between the finger-like members 11 and opposite member 18. According to a preferred embodiment, the opposite member 18 is realized as magnetic stop, in which the member 18 can be shifted to a desired place on the supporting surface 14.

Figure 19:
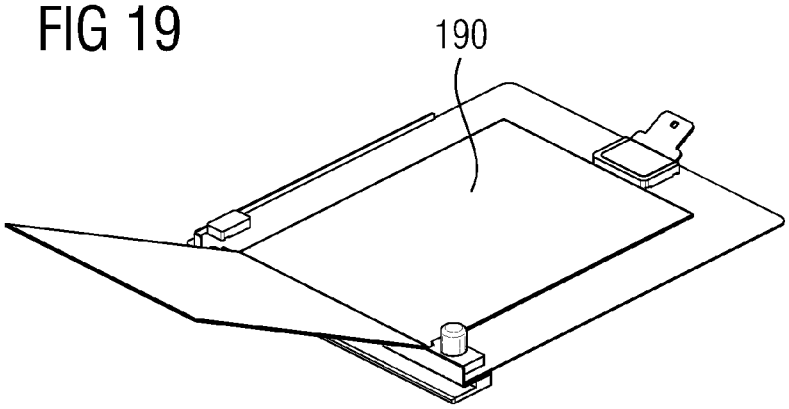

FIG. 19 illustrates, how a hard book cover 190 can be placed on binding platform 10 such, that one side of the cover of book cover 190 remains between the finger-like members 11 and the member 18 located opposite to them.

Figure 20:
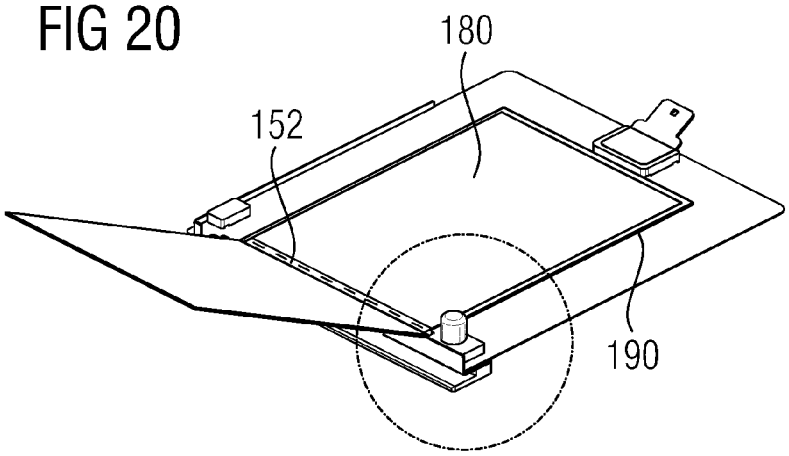
Figure 21:
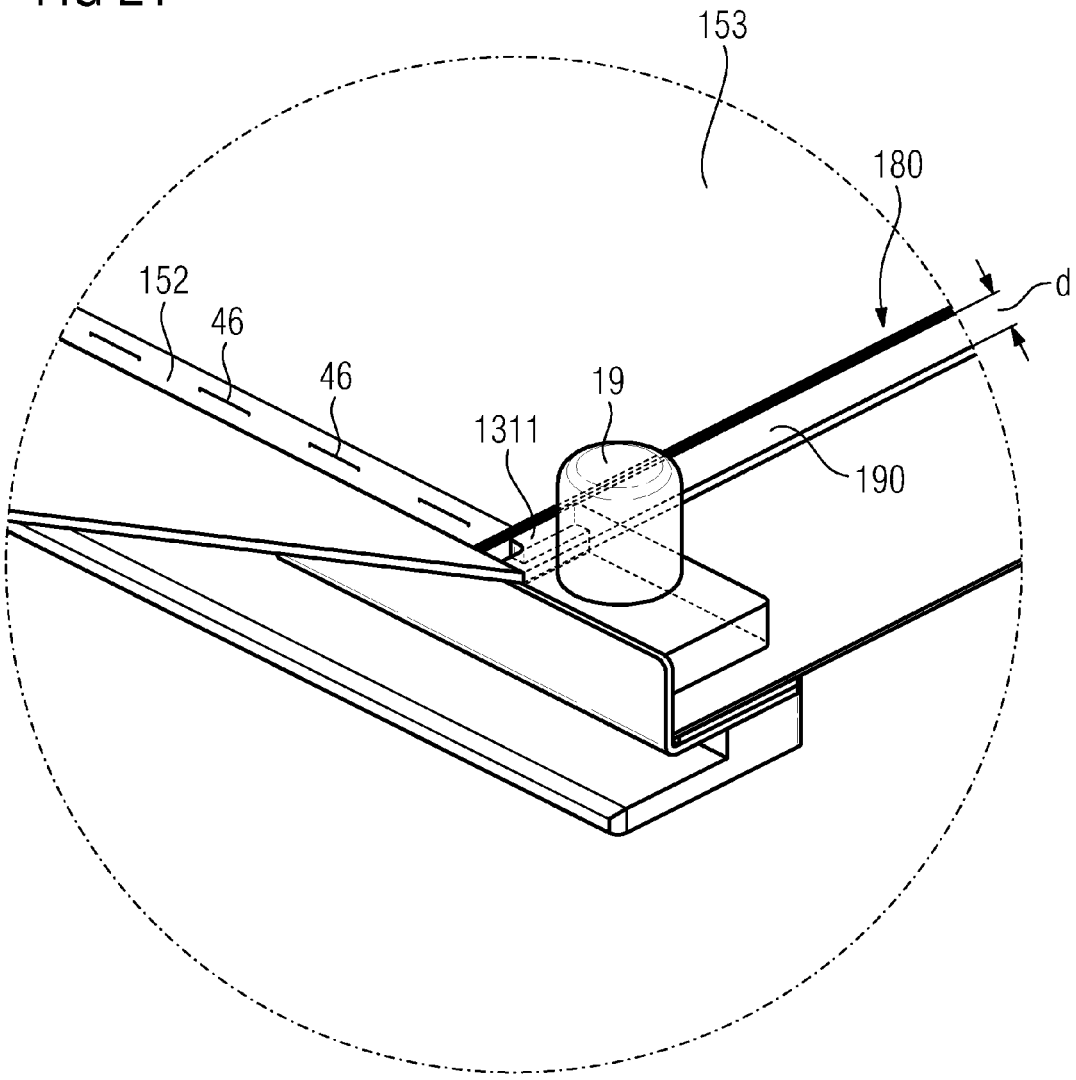
FIG. 21 is a detailed view of the arrangement shown in FIG. 20.

The binding platform 10 additionally comprises a lateral guiding device 1311 (FIG. 21), under which the book cover 190 can be pushed in in a lateral direction in the way shown in FIG. 20. The part of the book cover 190 resting on the supporting surface 14 is pushed slightly to the side, in which it gets below the lateral guiding device 1311 by distance d.

The bound bundle of sheets 180, which has to be placed on the part of the book cover 190 resting on supporting surface 14, is aligned with the lateral guiding device 1311. Then, the edge of the bound bundle of sheets 180 is indented by distance d with respect to the edge of the book cover 190. Distance d may be varied, if a stopper is arranged below the guiding device 1311, whose distance from guiding device 1311 can be adjusted.

If alignment with respect to the bound bundle of sheets 180 and the book cover 190 is correct, protective paper 153 of the self-adhesive surface of inner cover sheet 151 is removed. Thereafter, the self-adhesive surface is glued to the free inner part of book cover 190 (this is the part of the cover lying on the finger-like members 11 in the case of FIG. 20). After this, book cover 190 is turned around and protective paper 153 of the other inner cover sheet's 151 self-adhesive surface is removed. Thereafter, this self-adhesive surface is glued to that inner part of the book cover 190, which has remained unglued up to then. In other words, the hard book cover 190 is positioned between the finger-like members 11 and opposite member 18 and is pushed below the lateral guiding device 1311. Thereafter, the bound bundle of sheets 180 is pushed against the lateral guiding device 1311. Thereafter, the protective paper is removed from the self-adhesive sheet or sheets 153 and the bound bundle of sheets 180 is fixed to the cover 190 of the book.

Figure 5:
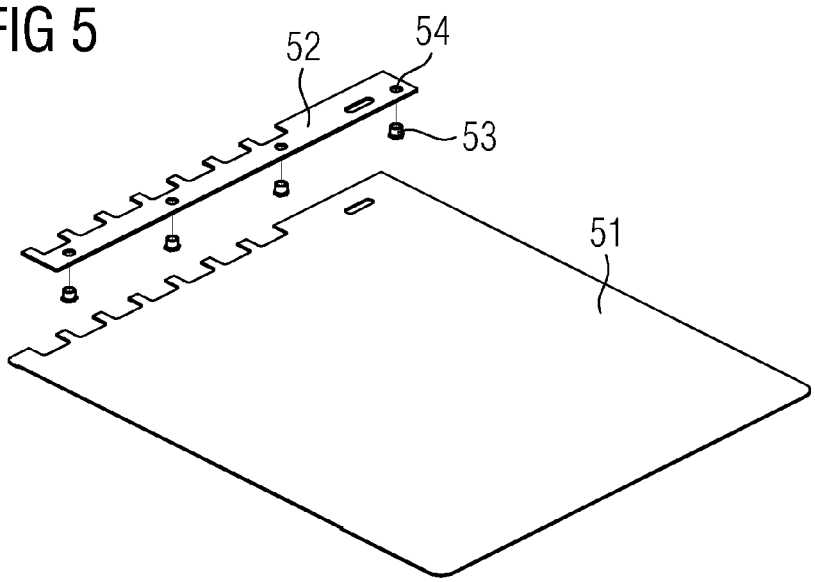
FIGS. 5 and 6 are an exploded view of the binding platform according to the invention.
Figure 6:
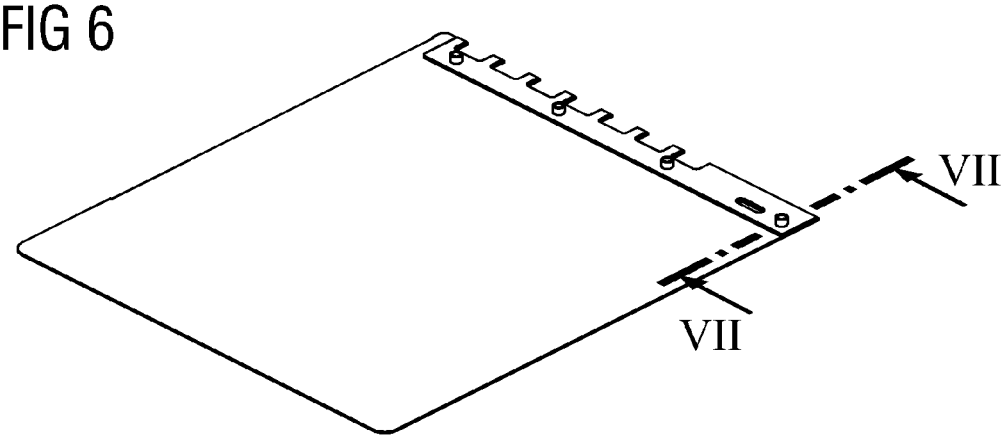
Figure 7:
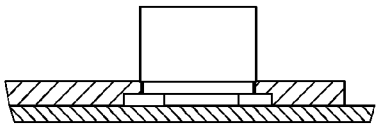
FIG. 7 is a cross-section along lines VII-VII of the exploded view shown in FIG. 6.
Figure 8:
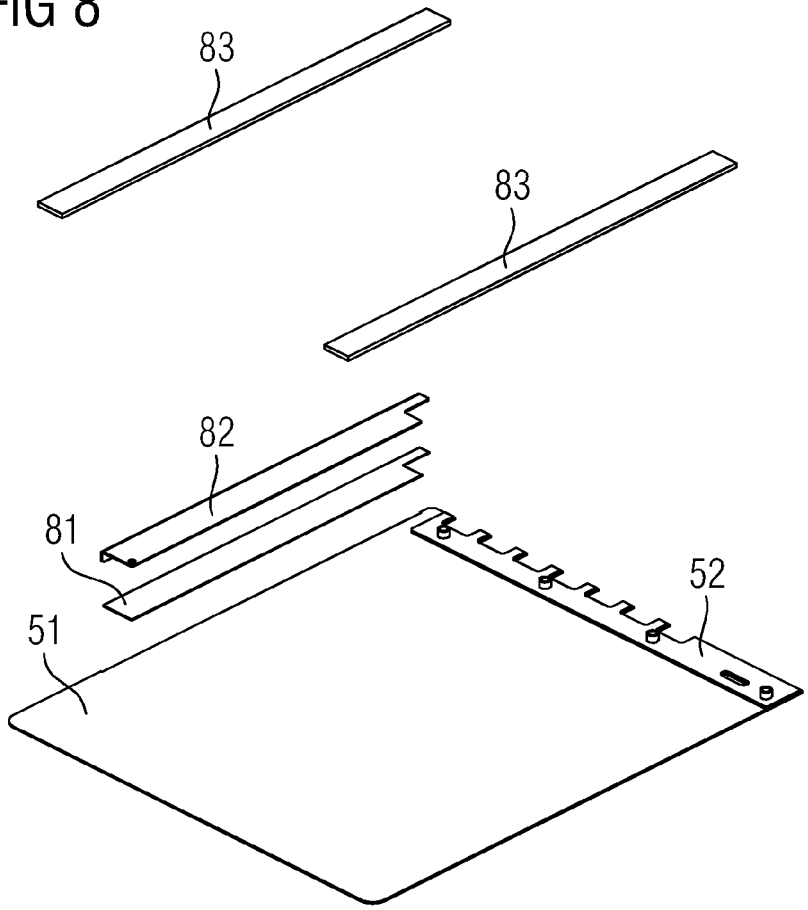
FIGS. 8-11 are exploded views of the binding platform of the invention.
Figure 9:
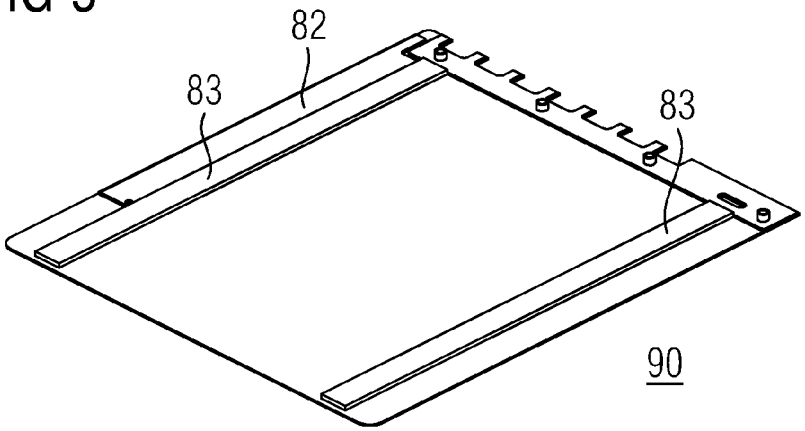
Figure 10:
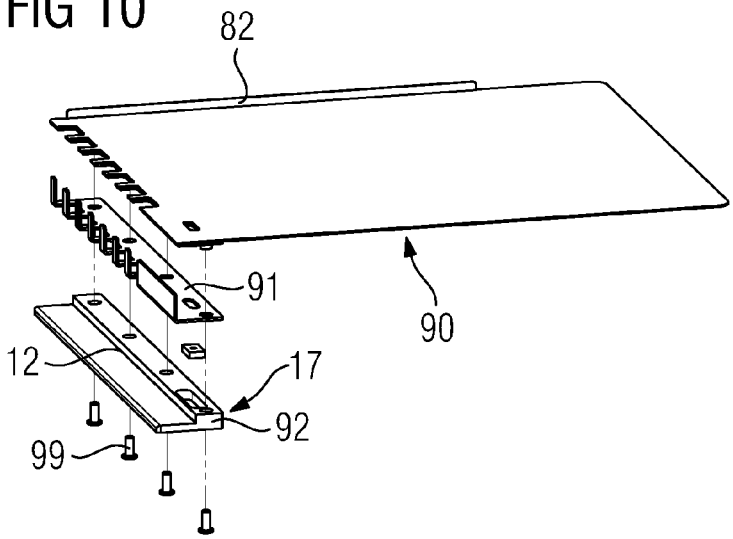

FIGS. 5 and 6 show an exploded view of the binding platform 10 and FIG. 7 shows a cross-section along lines VII-VII of the exploded view shown in FIG. 6. A pattern of notches is provided in plate 51, the pattern of notches repeating the form of the inner edge of stapling gap 16. A batten 52 having the pattern of notches is placed on plate 51 with fittings 53 being mounted in the holes 54 of the batten 52.

Figure 11:
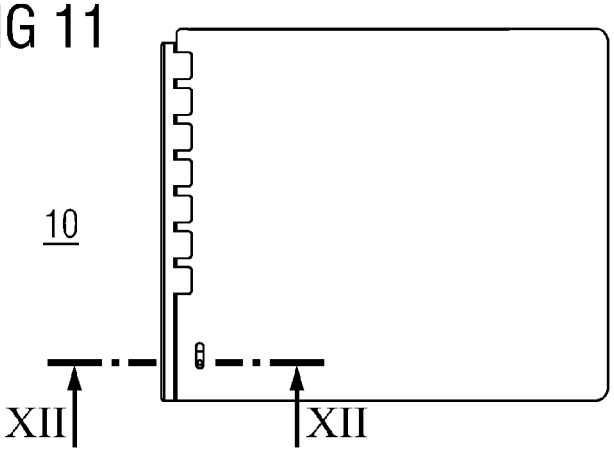
Figure 12:
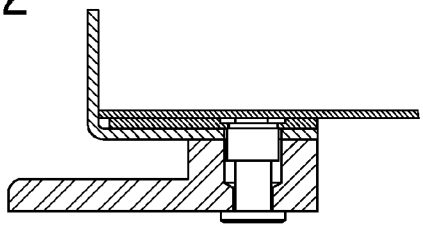
FIG. 12 is a cross-section along lines XII-XII of the exploded view shown in FIG. 11.

FIGS. 8-11 show exploded views of the binding platform 10 and FIG. 12 shows a cross-section along lines XII-XII of the exploded view shown in FIG. 11. Strips 83, which are made of a material having a high coefficient of friction, for example Neoprene, are mounted on plate 51. In addition to that a shim 81 and a profiled batten 82 are mounted on plate 51. The profiled batten 82 results in a strip visible adjacent to paper straightener 15 in FIG. 1. Thereby, the bottom part 90 of the binding platform 10 is complete.

After that, bottom part 90 is turned around. On the side of plate 51 remaining below, that is through the fittings 53, a finger member 91 and a limiter supporting member part 92 are mounted. The parts of the construction are fixed to the bottom part 90 by bolts or screws 99 by means of fittings 53.

Figure 13:
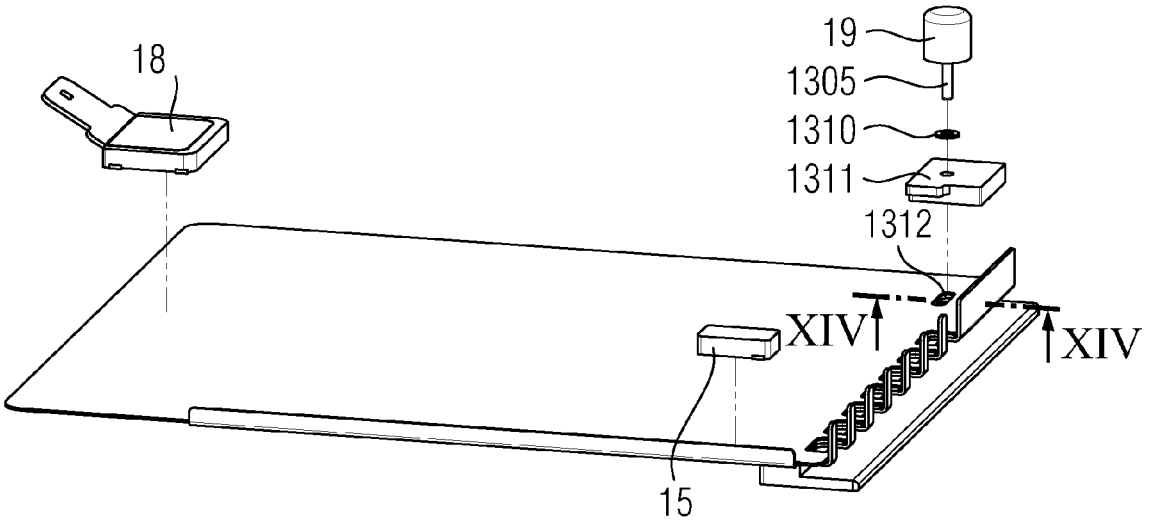
FIG. 13 is an exploded view of the binding platform of the invention.
Figure 14:
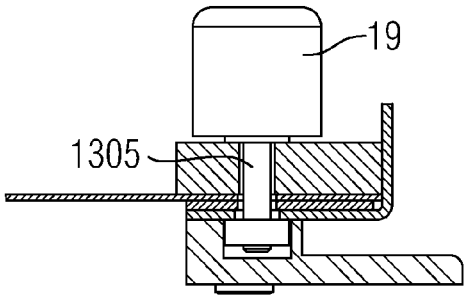
FIG. 14 is a cross-section along lines XIV-XIV of the exploded view shown in FIG. 13.

FIG. 13 shows an exploded view of the binding platform and FIG. 14 shows a cross-section along lines XIV-XIV of the exploded view shown in FIG. 13. The opposite member 18, which is preferably realized by means of a magnet as a part to be fixed to supporting surface 14, is clicked into its position.

Threaded foot 1305 of thumb screw 19 is pushed into fastening position 1312 through a washer 1310 and the hole located in the lateral guiding device 1311. If fastening position 1312 is made elongate, the distance between lateral guiding device 1311 and the finger-like members 11 can be adjusted.

Modifications and substitutions by one of ordinary skill in the art are considered to be within the scope of the present invention, which is not to be limited except by the allowed claims and their legal equivalents.

The invention claimed is:

1. A binding platform (10) for use in bookbinding comprising:

a supporting surface (14) suitable for supporting a bundle of sheets;

a plurality of finger-like members (11), extending from an edge of supporting surface (14) essentially perpendicularly to the supporting surface (14) and against which a rear edge (152) of a bundle of sheets (49) to be placed on supporting surface (14) can be aligned, wherein said plurality of finger-like members are configured in such a way that a stapling gap (16) remains between each of the plurality of finger-like members (11); and at least one limiter (12) located under the finger-like members (11) and the supporting surface (14), the limiter (12) being indented with respect to an inner edge of the stapling gaps (16).

2. The binding platform (10) according to claim 1, in which the width of limiter (12) is equal to or wider than a distance between first and second outermost stapling gaps (16).

3. The binding platform (10) according to claim 1, in which, in combination with the at least one limiter (12), there is included at least one supporting member (13) disposed under or extending under stapling gap (16).

4. The binding platform (10) according to claim 3, in which the supporting member (13) comprises a continuous plane having a width that is equal to or wider than the distance between first and second outermost stapling gaps (16).

5. The binding platform (10) according to claim 1, wherein said binding platform can be supported on the edge of a worktable.

6. The binding platform (10) according to claim 5, which is configured in such a way that an inner side (17) of limiter (12) and a point of attachment of supporting surface (14) form a corner that can be supported on the edge of said worktable.

7. The binding platform (10) according to claim 1, further comprising a lateral edge level (15), which is located on supporting surface (14), and indented with respect to an inner edge of the stapling gaps (16).

8. The binding platform (10) according to claim 1 wherein the plurality of finger-like members (11) are formed from a deflected plate.

9. The binding platform (10) according to claim 8, in which the supporting surface (14) consists of a plate that is set against the plurality of finger-like members (11) in such a way that a raising plate (21) is mounted between the said plate forming the supporting surface (14) and the deflected plate forming the plurality of finger-like members in order to compensate for a curvature resulting from the deflection in the plate forming the plurality of finger-like memebrs (11), thus causing the finger-like members (11) to form an essentially right angle with the binding platform (10) and supporting surface (14).

10. The binding platform (10) according to claim 1, which additionally comprises a member (18) disposed on the supporting surface (14) opposite the plurality finger-like members (11), for positioning a book cover (190) between the plurality of finger-like members (11) and the opposite member (18).

11. The binding platform (10) according to claim 10, which additionally comprises a lateral guiding device (1311), under which a book cover (190) can be pushed in a lateral direction and against which a bound bundle of sheets (180) can be aligned with respect to the book cover (190).

12. The binding platform (10) according to claim 11, further including under said guiding device (1311) is a stopper wherein the distance from said stopper to said guiding device (1311) can be adjusted.

13. A method for binding a bundle of sheets, characterized in that the bundle of sheets (180) is bound at its one edge by using the binding platform (10) according to claim 12 in conjunction with a pliers stapler (100).

14. The method according to claim 13, in which a self-adhesive sheet (153) is used as a top and/or bottom sheet (151) in the bundle of sheets (42, 180) to be bound, which self-adhesive sheet most advantageously has at least one attenuation member (152) at its rear edge.

15. The method according to claim 14, in which the hard book cover (190) is positioned between the finger-like members (11) and the opposite member (18) and is pushed under the lateral guiding device (1311), following which the bound bundle of sheets (180) is pushed against the lateral guiding device (1311), following which the protective paper is removed from the self-adhesive sheet or sheets (153) and the bound bundle of sheets (180) is fixed to the book cover (190).

16. The binding platform (10) according to any claim 1, further including a pliers stapler (100), and wherein a width of a mouth region (110) of the pliers stapler (100) is less than a width (B) of the stapling gaps (16), in which case the pliers stapler (100) can be used for fixing the bundle of sheets at the stapling gap or gaps (16).

* * * * *